US010876245B2

(12) United States Patent
Channal et al.

(10) Patent No.: US 10,876,245 B2
(45) Date of Patent: Dec. 29, 2020

(54) WASHING MACHINE APPLIANCE WITH A SMART ADDITIVE BULK DISPENSING ASSEMBLY

(71) Applicant: Haier US Appliance Solutions, Inc., Wilmington, DE (US)

(72) Inventors: Rajendra Channal, Hyderabad (IN); Manidhar V V S Yandamuri, Hyderabad (IN); Hanuman Devadatha Seela, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 291 days.

(21) Appl. No.: 15/992,260

(22) Filed: May 30, 2018

(65) Prior Publication Data

US 2019/0368108 A1 Dec. 5, 2019

(51) Int. Cl.

| | |
|---|---|
| ***D06F 23/02*** | (2006.01) |
| ***D06F 33/37*** | (2020.01) |
| ***D06F 34/04*** | (2020.01) |
| ***D06F 39/02*** | (2006.01) |
| ***D06F 39/12*** | (2006.01) |
| *D06F 105/58* | (2020.01) |
| *D06F 103/22* | (2020.01) |

(52) U.S. Cl.

CPC ..... *D06F 39/022* (2013.01); *D06F 23/02* (2013.01); *D06F 33/37* (2020.02); *D06F 34/04* (2020.02); *D06F 39/12* (2013.01); *D06F 2103/22* (2020.02); *D06F 2105/58* (2020.02); *D06F 2210/00* (2013.01)

(58) Field of Classification Search

CPC ..... D06F 23/02; D06F 33/37; D06F 34/04; D06F 39/022; D06F 39/12; D06F 2103/22; D06F 2105/58; D06F 2210/00

USPC ..... 68/12.18, 17 R

See application file for complete search history.

(56) References Cited

U.S. PATENT DOCUMENTS

| | | | | |
|---|---|---|---|---|
| 8,266,748 | B2 | 9/2012 | Hendrickson et al. | |
| 8,931,310 | B2 | 1/2015 | Risen et al. | |
| 9,181,650 | B2 | 11/2015 | D'Andrea et al. | |
| 2012/0266389 | A1* | 10/2012 | Ihne | D06F 39/028 8/137 |
| 2017/0268151 | A1 | 9/2017 | Leibman et al. | |

OTHER PUBLICATIONS

Cindy Bailen, You can pour detergent into these washing machines only once a month, http://laundry.reviewed.com/features/you-pour-detergent-into-these-washing-machines-once-a-month, Sep. 19, 2017, pp. 1-2.

GE Profile™ 15" Frontload SmartDispense™ Pedestal, https://www.geapplianceparts.com/store/parts/spec/SPBD880JMV, pp. 1-3.

* cited by examiner

*Primary Examiner* — Levon J Shahinian

(74) *Attorney, Agent, or Firm* — Dority & Manning, P.A.

(57) ABSTRACT

A washing machine appliance configured with a smart additive bulk dispensing assembly is provided. The washing machine appliance includes a large capacity or bulk tank and features for dispensing an appropriate amount of additive in accordance with the selected wash cycle. The washing machine appliance also includes features for managing the additive supply within the tank.

18 Claims, 13 Drawing Sheets

WASHING MACHINE APPLIANCE WITH A SMART ADDITIVE BULK DISPENSING ASSEMBLY

FIELD OF THE INVENTION

The present disclosure relates generally to washing machine appliances and more particularly to washing machine appliances configured with an additive bulk dispensing assembly.

BACKGROUND OF THE INVENTION

Washing machine appliances generally include a drum or basket rotatably mounted within a tub of a cabinet. The basket defines a wash chamber for receiving articles for washing. During operation, wash fluid is directed into the tub and onto articles within the wash chamber. The wash fluid may be a mixture of water and one or more additives, such as e.g., liquid detergent, powder detergent, bleach, softener, etc. Typically, a dispensing assembly dispenses or directs the wash fluid into the tub.

Dispensing assemblies of certain washing machine appliances typically include a tank or reservoir for containing the additive. During a wash cycle, the additive is released from the tank so that it may be mixed with water to form a wash fluid. In some instances, the capacity of the tank is such that a user must refill the tank with a new supply of additive (e.g., a liquid detergent) after each wash cycle. Accordingly, a user is required to frequently refill the tank or reservoir, which may be troublesome and/or time consuming. Further, users may add too much or too little additive into the tank, which may negatively affect wash performance. In addition, in some cases, a user may be unaware of his or her current supply of additive and thus may run a wash cycle with an insufficient amount of additive or may be inconvenienced by the wait time to obtain a new supply of additive when articles may need prompt washing.

Therefore, a washing machine appliance that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

One aspect of the present disclosure is directed to a horizontal axis washing machine appliance. The horizontal axis washing machine appliance includes a cabinet and a tub positioned within the cabinet. The horizontal axis washing machine appliance also includes a basket rotatably mounted within the tub, the basket defining a wash chamber for receipt of articles for washing. Further, the horizontal axis washing machine appliance includes a water inlet valve in fluid communication with a water source. The horizontal axis washing machine appliance also includes a dispensing assembly. The dispensing assembly includes a manifold and a drawer assembly slidably received within the manifold and movable between a withdrawn position and a retracted position, the drawer assembly comprising a drawer defining one or more additive compartments and a filling compartment configured for receipt of a fluid additive. Further, the dispensing assembly includes a bulk tank in fluid communication with the filling compartment. The dispensing assembly also includes a tub supply conduit, the tub supply conduit providing fluid communication between the one or more additive compartments and the tub. In addition, the dispensing assembly includes a pump in fluid communication with the bulk tank and the tub supply conduit for selectively directing the fluid additive from the bulk tank to the tub.

Another aspect of the present disclosure is directed to a washing machine appliance. The washing machine appliance includes a cabinet extending between a front and a back and between a top and a bottom. The washing machine appliance also includes a tub positioned within the cabinet and a basket rotatably mounted within the tub, the basket defining a wash chamber for receipt of articles for washing. Further, the washing machine appliance includes a water inlet valve in fluid communication with a water source. In addition, the washing machine appliance includes a dispensing assembly that includes a manifold and a drawer assembly slidably received within the manifold and movable between a withdrawn position and a retracted position, the drawer assembly comprising a drawer defining one or more additive compartments and a filling compartment configured for receipt of a fluid additive. Further, the dispensing assembly includes a bulk tank fixed relative to the cabinet and in fluid communication with the filling compartment, the bulk tank positioned at or adjacent the top and the back of the cabinet. The dispensing assembly also includes a tub supply conduit, the tub supply conduit providing fluid communication between the one or more additive compartments and the tub. Further, the dispensing assembly includes a pump in fluid communication with the bulk tank and the tub supply conduit for selectively directing the fluid additive from the bulk tank to the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
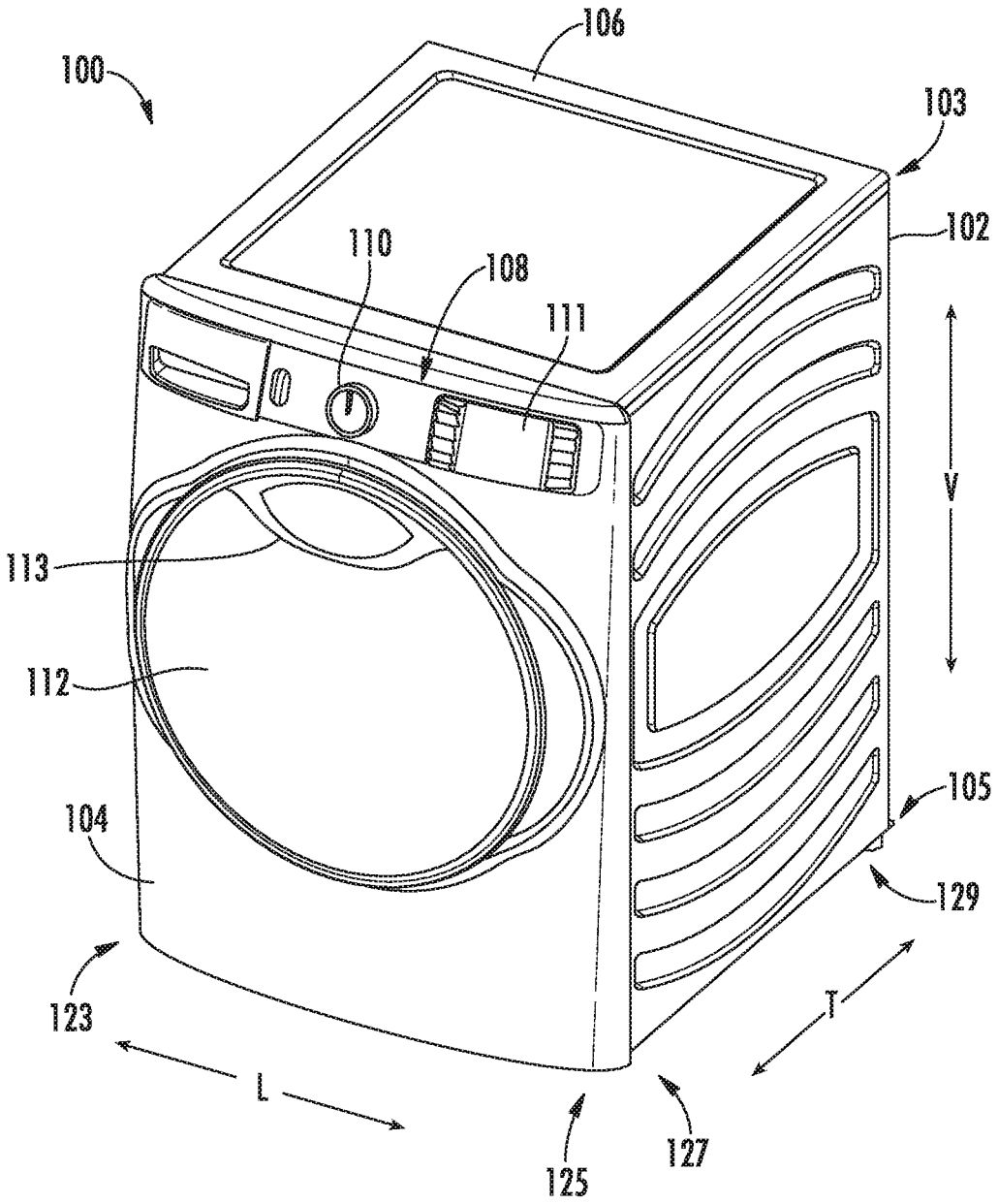
FIG. 1 provides a front, perspective view of a washing machine appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
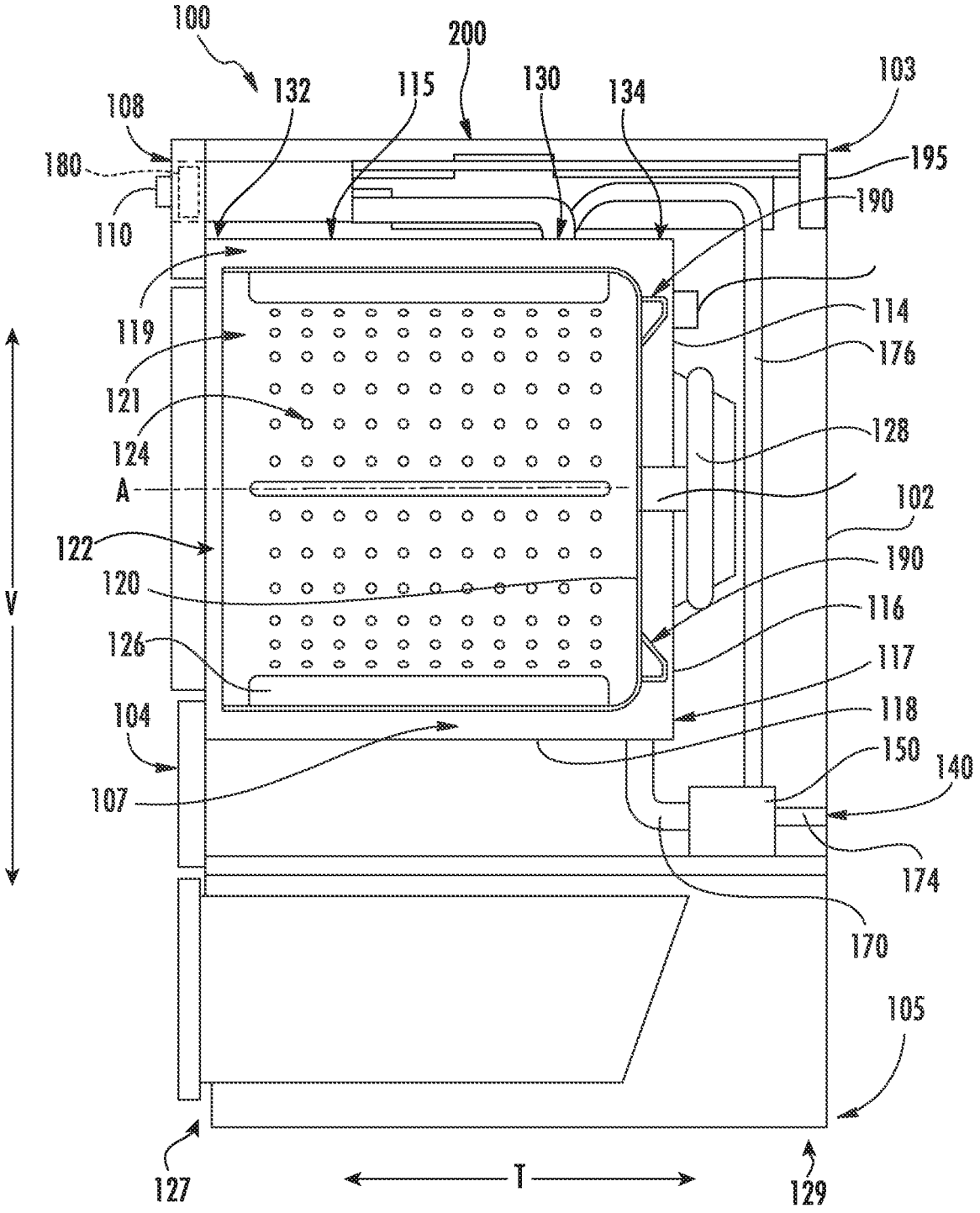
FIG. 2 provides a side, cross-sectional view of the exemplary washing machine appliance of FIG. 1.

FIGS. 1 and 2 provide various views of an exemplary horizontal axis washing machine appliance 100 according to one exemplary embodiment of the present disclosure. In particular, FIG. 1 provides a front, perspective view of horizontal axis washing machine appliance 100 and FIG. 2 provides a side, section view of washing machine appliance 100. As shown in FIG. 1, washing machine appliance 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by washing machine appliance 100 are mutually perpendicular and together define an orthogonal direction system.

Cabinet 102 includes a front panel 104. A door 112 is mounted to front panel 104 and is rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 also includes a top panel 106 positioned at top 103 of cabinet 102.

A control panel 108 including a plurality of input selectors 110 is coupled to front panel 104. Control panel 108 and input selectors 110 collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of washing machine appliance 100. Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. In particular, a shaft 136 mechanically couples motor 128 with basket 120 and drivingly rotates basket 120 about a shaft or central axis A, e.g., during a spin cycle. Ribs 126 extend from basket 120 into wash chamber 121. Ribs 126 assist agitation of articles disposed within wash chamber 121 during operation of washing machine appliance 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in washing machine appliance 100 and can be placed according to any known or desirable configuration. For example, two balancing rings can be respectively placed at the front and back of basket 120.

As further shown in FIG. 2, washing machine appliance 100 includes a dispensing assembly 200. Dispensing assembly 200 includes features for receiving various wash treatment additives (e.g., fluid detergent, powder detergent, fabric softener, bleach, powder or any other suitable liquid) and dispensing or directing them to wash fluid compartment 119 of tub 114 during operation of washing machine appliance 100. Dispensing assembly 200 will be described in further detail herein.

Operation of washing machine appliance 100 is controlled by a processing device or controller 180 that is operatively coupled to control panel 108 for user manipulation to select washing machine cycles and features. In response to user manipulation of control panel 108, controller 180 operates the various components of washing machine appliance 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of washing machine appliance 100 may be in communication with controller 180 via one or more signal lines or shared communication busses.

In an illustrative example of operation of washing machine appliance 100, laundry items are loaded into basket 120, and washing operation is initiated through operator manipulation of input selectors 110. Tub 114 is filled with water and one or more wash treatment additives from dispensing assembly 200 to form a wash fluid. One or more valves of a water inlet valve 195 can be actuated by controller 180 to provide for filling tub 114 to the appropriate level for the amount of articles being washed. Water inlet valve 195 is in fluid communication with a water source, such as e.g., a hot water heater and/or a municipal water line. Once tub 114 is properly filled with wash fluid, the contents of basket 120 are agitated with ribs 126 for cleansing of laundry items in basket 120.

After the agitation phase of the wash cycle is completed, tub 114 is drained. Laundry articles can then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well, including, for example, vertical axis washing machine appliances. Thus, the teachings of the present disclosure are not limited to use with washing machine appliance 100.

Figure 3:
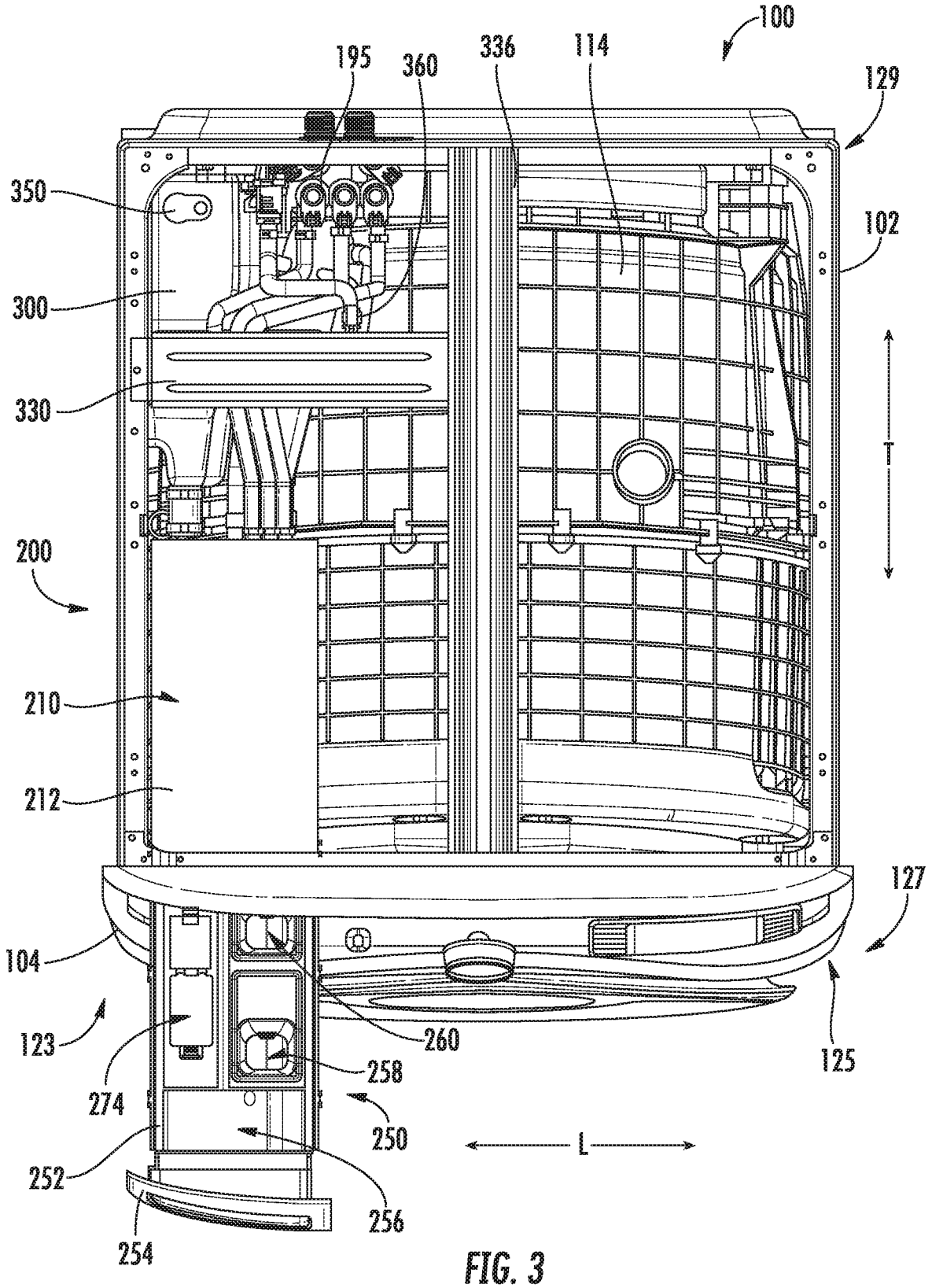
FIG. 3 provides a top view of the washing machine appliance of FIG. 1 with a top panel removed to illustrate a dispensing assembly.
Figure 4:
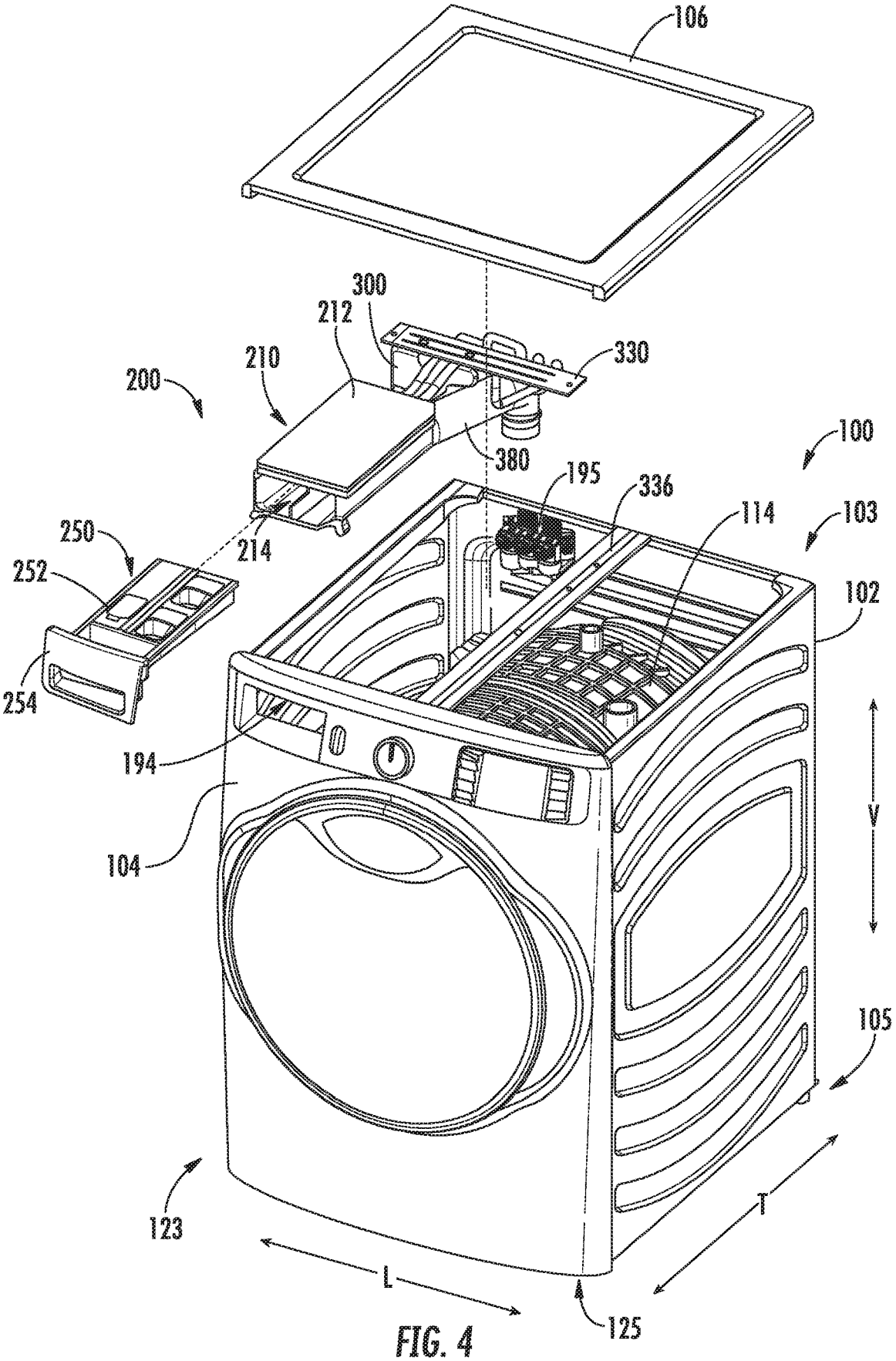
FIG. 4 provides a partial exploded perspective view of the dispensing assembly of the washing machine appliance of FIG. 1.
Figure 5:
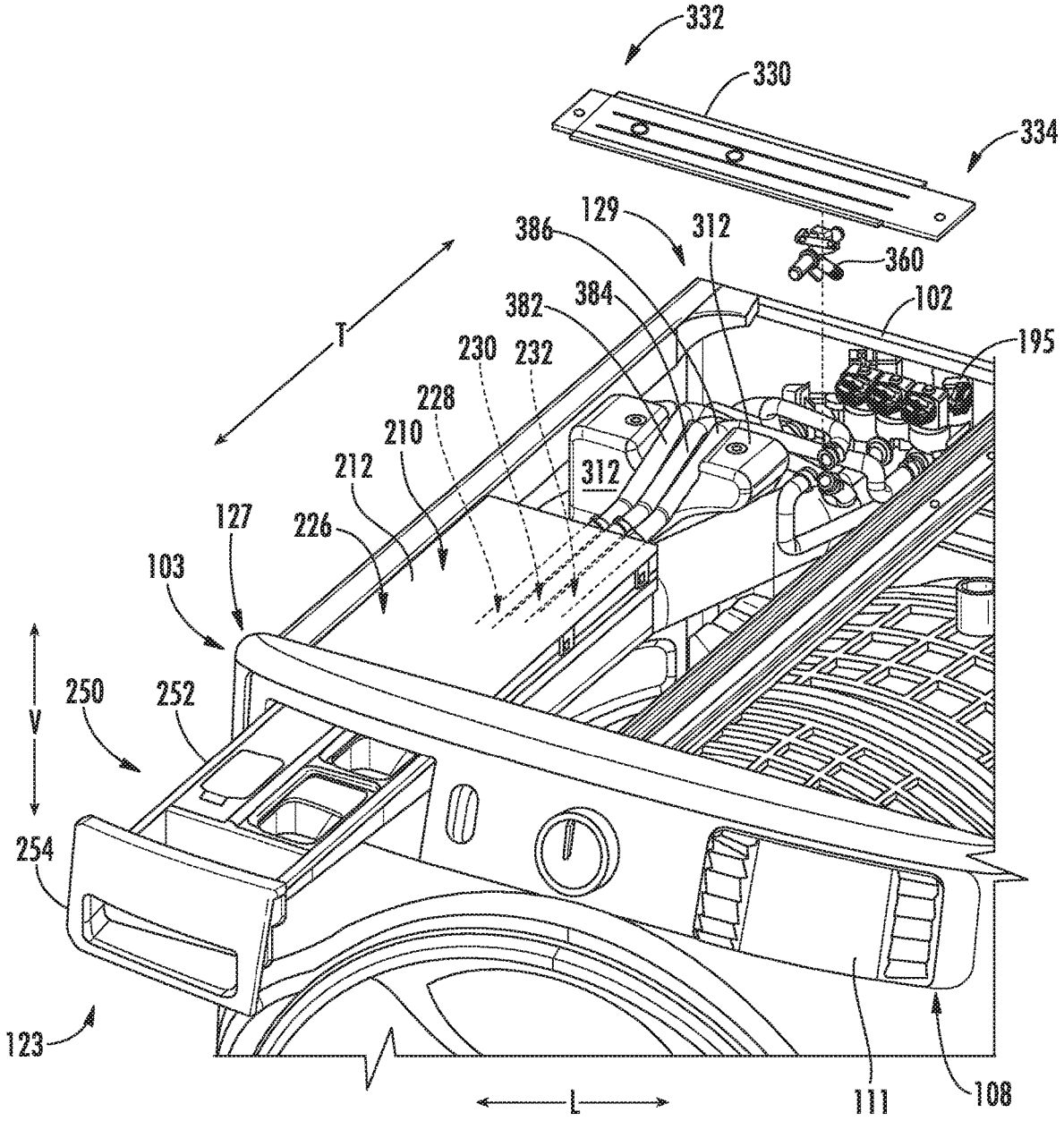
FIG. 5 provides a partial exploded perspective view of the dispensing assembly of the washing machine appliance of FIG. 1.
Figure 6:
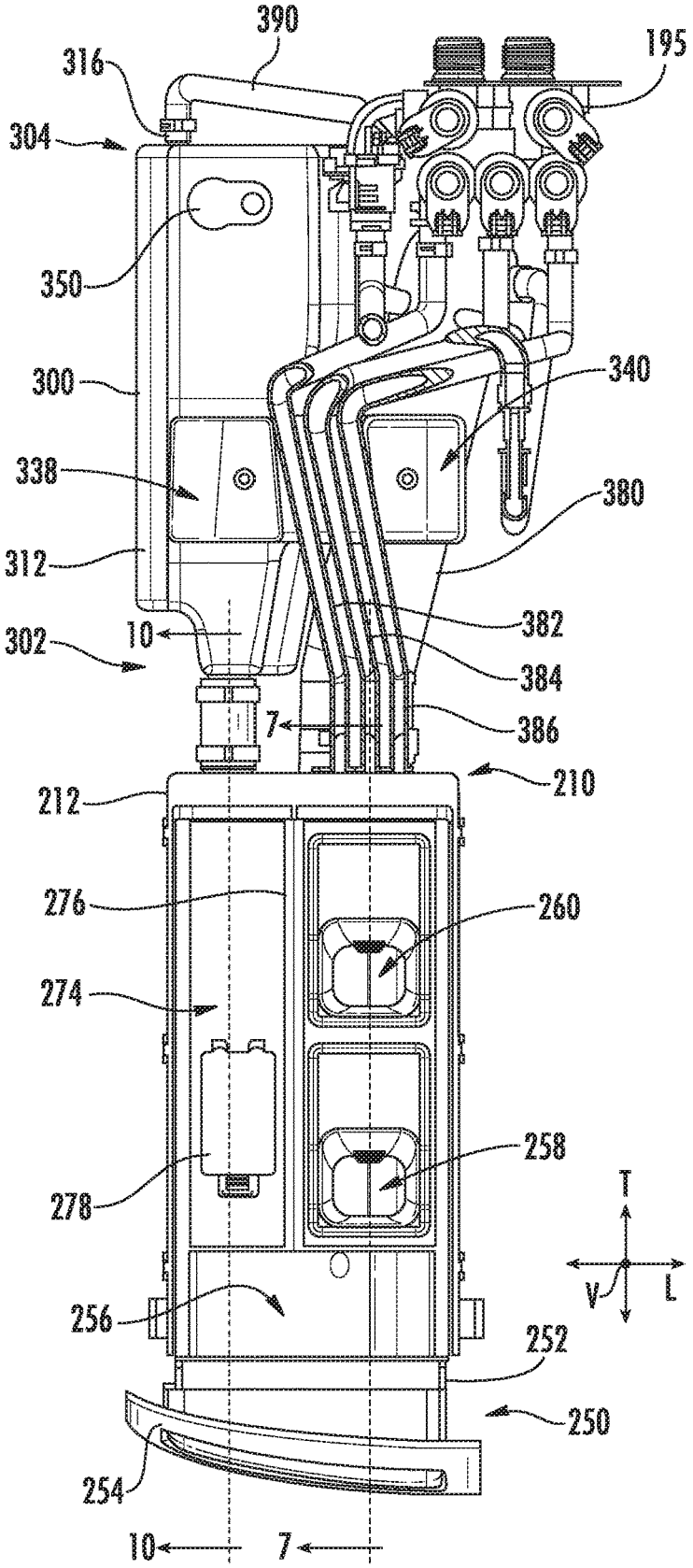
FIG. 6 provides a top, section view of the dispensing assembly of the washing machine appliance of FIG. 1.
Figure 7:
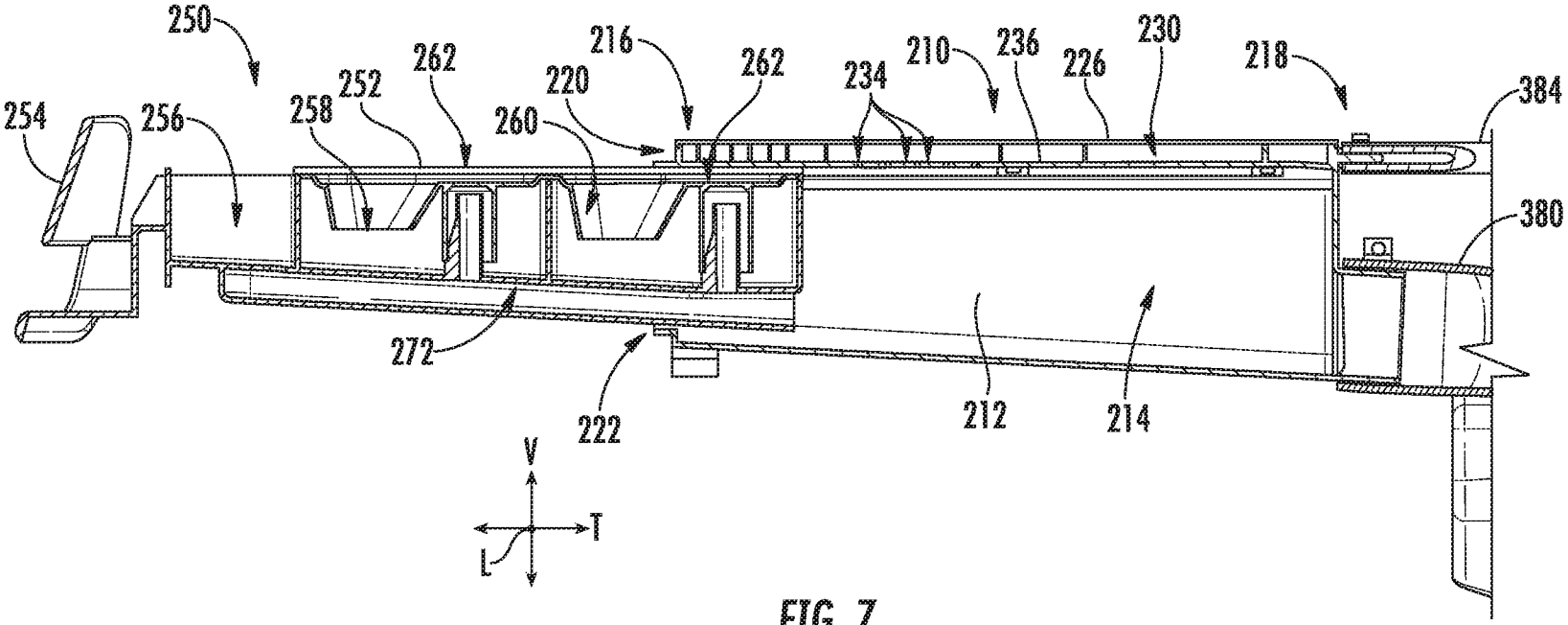
FIG. 7 provides a cross-sectional view of the dispensing assembly taken along line 7-7 of FIG. 6.
Figure 8:
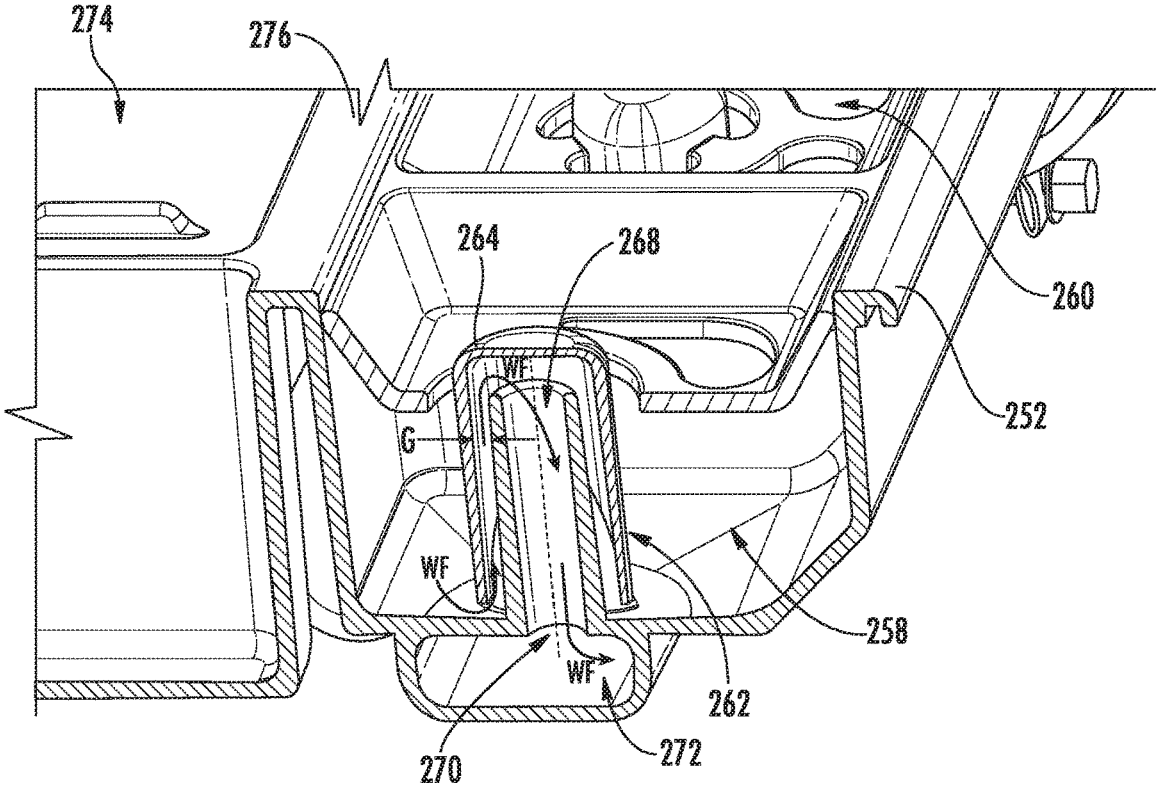
FIG. 8 provides a close up, cross sectional view of one additive compartment of the dispensing assembly of the washing machine appliance of FIG. 1.
Figure 9:
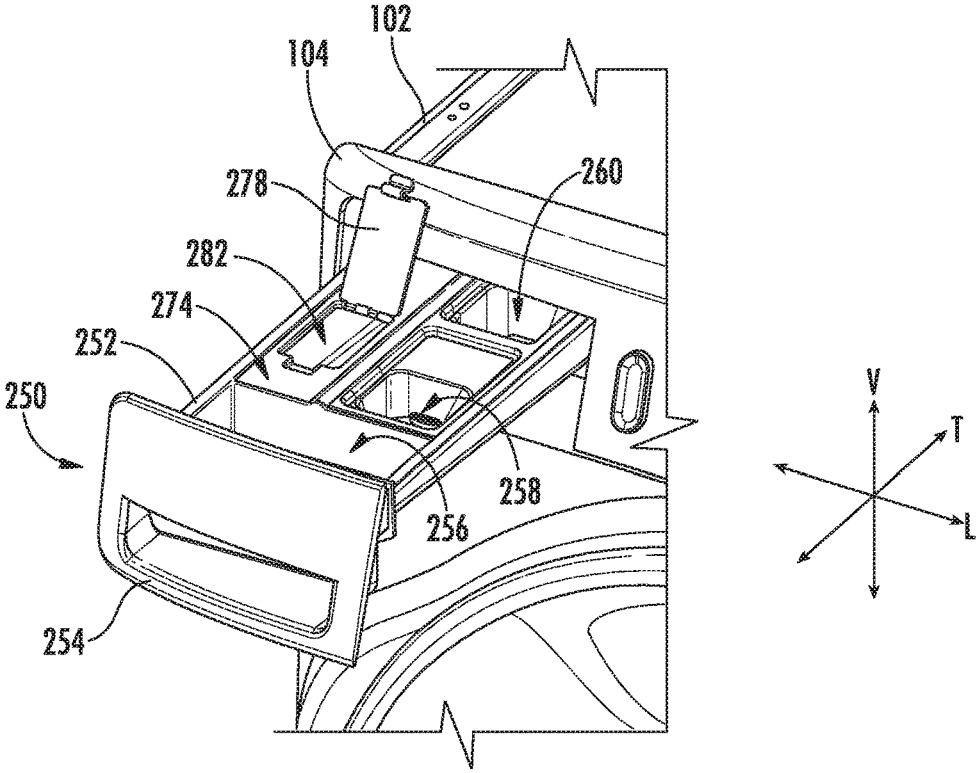
FIG. 9 provides a close up of a drawer assembly of the dispensing assembly of the washing machine appliance of FIG. 1.
Figure 10:
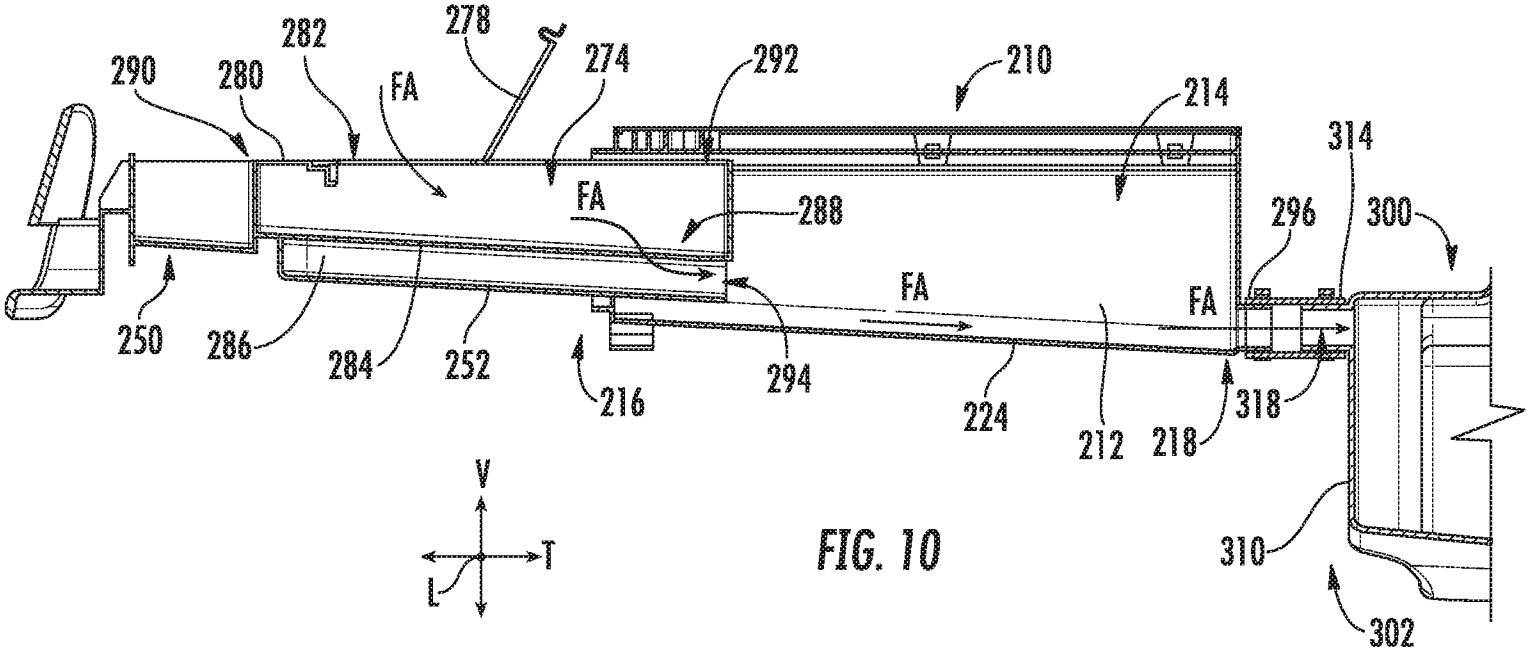
FIG. 10 provides a cross-sectional view of the dispensing assembly taken along line 10-10 of FIG. 6.
Figure 11:
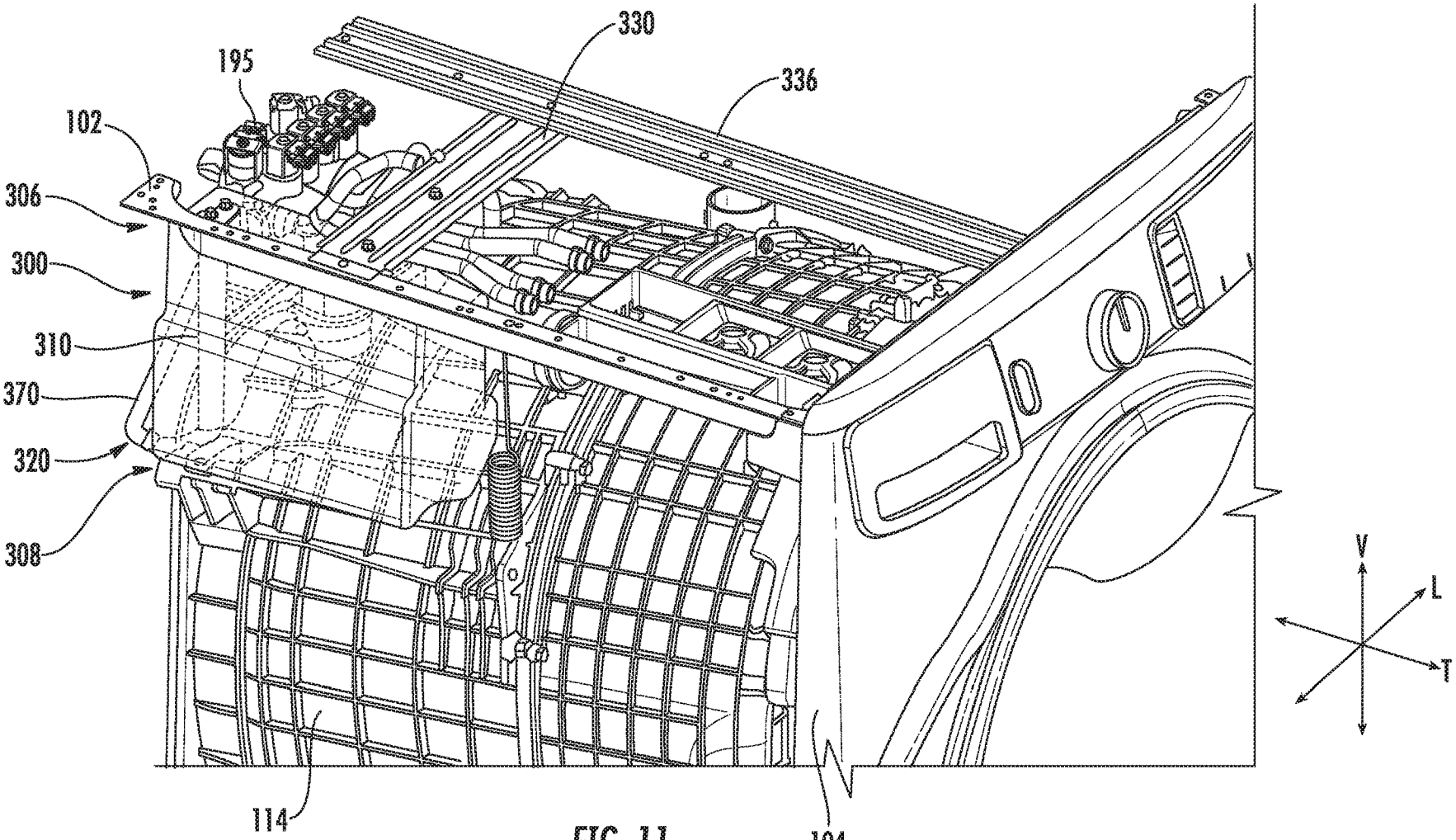
FIG. 11 provides a side perspective view of the dispensing assembly of the washing machine appliance of FIG. 1 with a portion of a cabinet removed for clarity.
Figure 12:
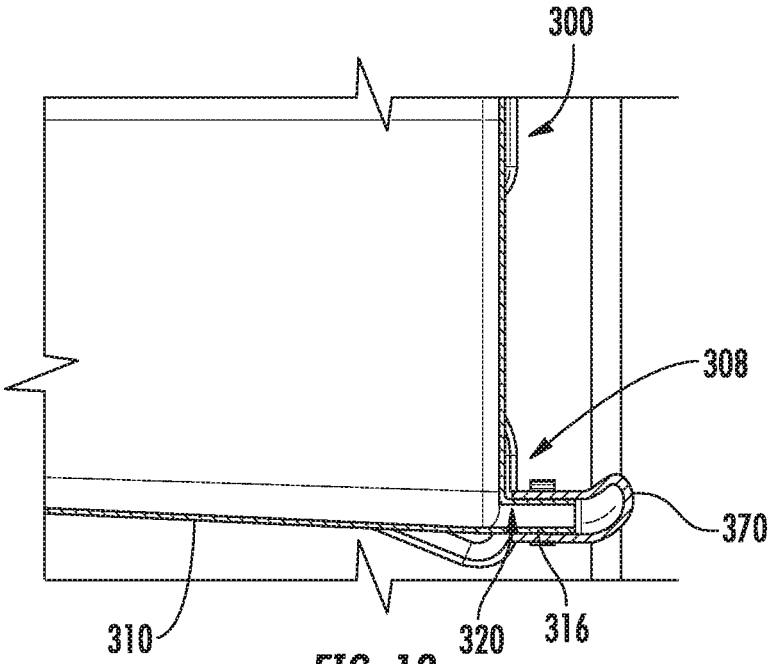
FIG. 12 provides a cross-sectional view of an outlet port of a bulk tank of the dispensing assembly of the washing machine appliance of FIG. 1.
Figure 13:
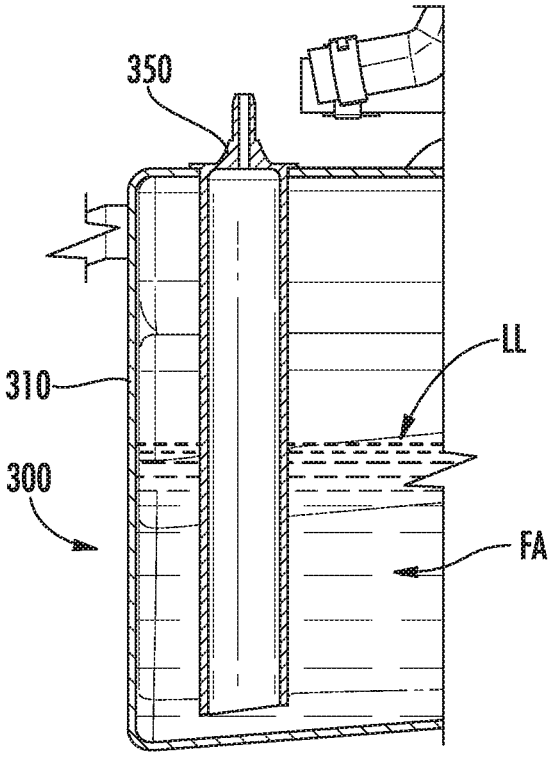
FIG. 13 provides a cross-sectional view of a liquid level sensor of the dispensing assembly of the washing machine appliance of FIG. 1.
Figure 14:
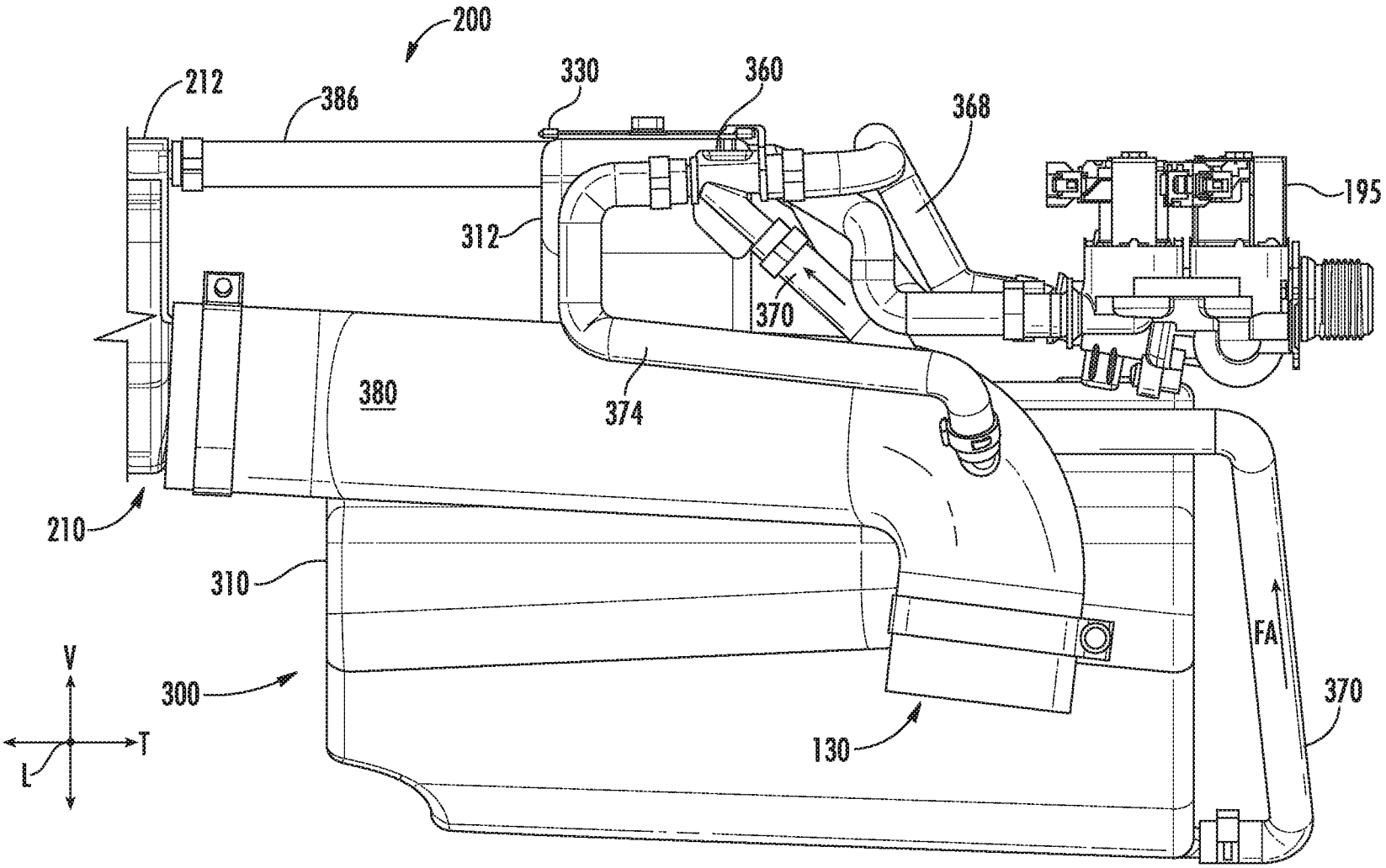
FIG. 14 provides a side view of a rear portion of the dispensing assembly of the washing machine appliance of FIG. 1.
Figure 15:
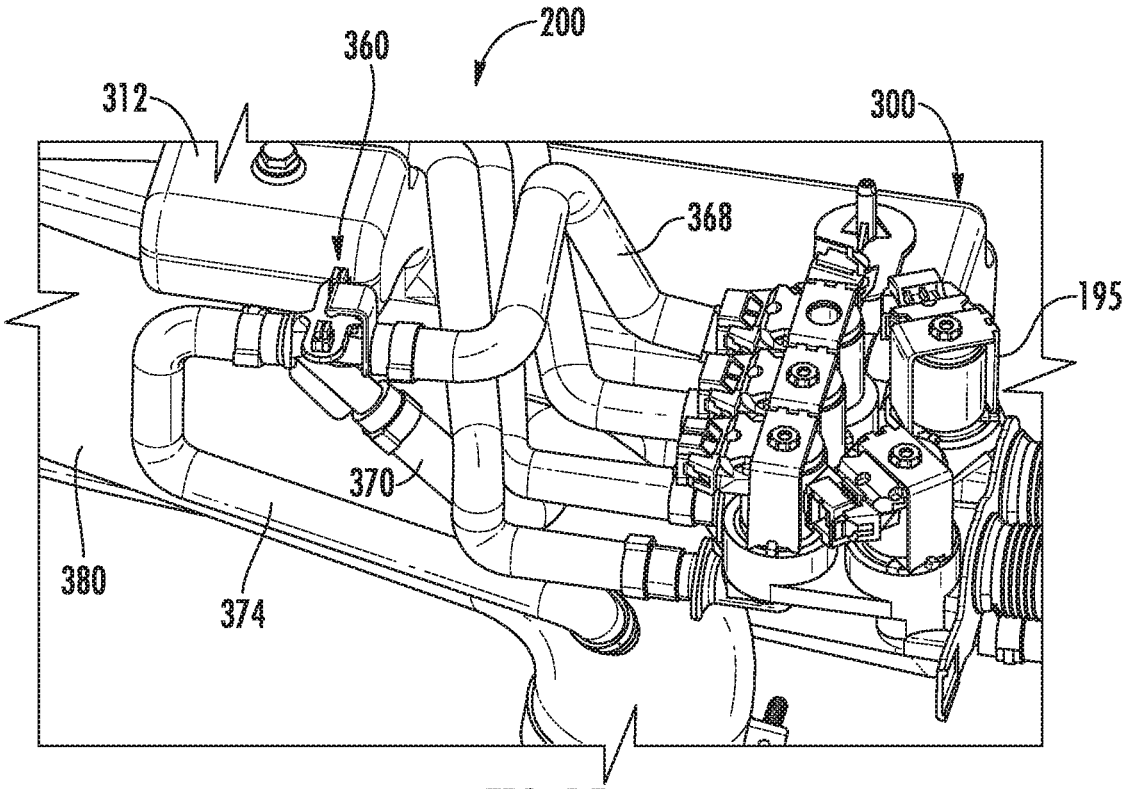
FIG. 15 provides a perspective view of the rear portion of the dispensing assembly of the washing machine appliance of FIG. 1.
Figure 16:
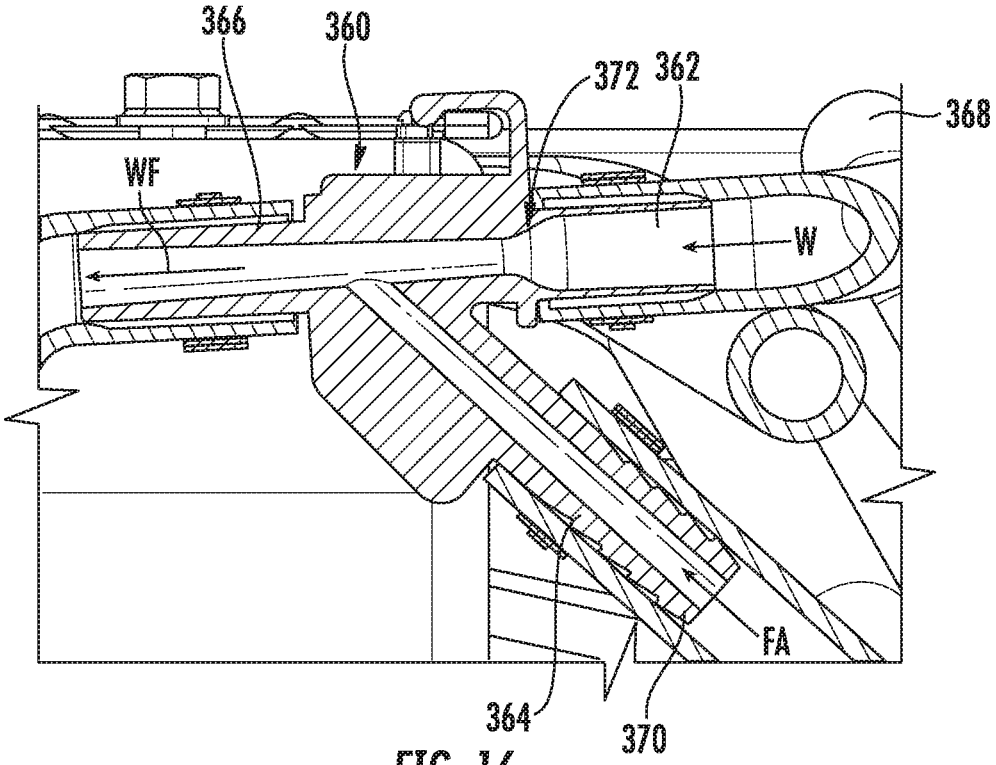
FIG. 16 provides a close up, cross-sectional view of a pump of the dispensing assembly of the washing machine appliance of FIG. 1.

FIGS. 3 through 13 provide various views of dispensing assembly 200 of the washing machine appliance of FIGS. 1 and 2 according to an exemplary embodiment of the present disclosure. More specifically, FIG. 3 provides a top view of washing machine appliance 100 with top panel 106 (FIG. 1) removed to more clearly illustrate dispensing assembly 200. FIG. 4 provides a partial exploded perspective view of dispensing assembly 200. FIG. 5 provides a close up, partial exploded perspective view of dispensing assembly 200. FIG. 6 provides a top, section view of dispensing assembly 200. FIG. 7 provides a cross-sectional view of dispensing assembly 200 taken along line 7-7 of FIG. 6. FIG. 8 provides a close up, cross sectional view of one additive compartment of dispensing assembly 200. FIG. 9 provides a close up view of a drawer assembly 250 of dispensing assembly 200. FIG. 10 provides a cross-sectional view of dispensing assembly 200 taken along line 10-10 of FIG. 6. FIG. 11 provides a side perspective view of dispensing assembly 200 with a portion of cabinet 102 removed for additional clarity. FIG. 12 provides a cross-sectional view of an outlet port 316 of a bulk tank 300 of dispensing assembly 200. FIG. 13 provides a cross-sectional view of a liquid level sensor 350 of dispensing assembly 200. FIG. 14 provides a side view of a rear portion of dispensing assembly 200. FIG. 15 provides a perspective view of the rear portion of dispensing assembly 200. FIG. 16 provides a close up, cross-sectional view of a pump of dispensing assembly 200.

As shown in FIG. 4, dispensing assembly 200 includes a diffuser assembly 210 and drawer assembly 250. Diffuser assembly 210 has a manifold 212 that has a generally rectangular shape. As best shown in FIGS. 4 and 7, manifold 212 extends between a front 216 and a back 218 (FIG. 7), e.g., along the transverse direction T, between a top 220 and a bottom 222 (FIG. 7), e.g., along the vertical direction V, and between a first side and a second side (FIG. 4), e.g., along the lateral direction L. Further, manifold 212 defines an interior volume 214. Interior volume 214 of manifold 212 is sized to receive at least portion of drawer assembly 250. For this embodiment, drawer assembly 250 is slidably received within manifold 212 (i.e., within interior volume 214 of manifold 212) between a withdrawn position (FIGS. 3 and 5) and a retracted position (FIGS. 1 and 6). That is, drawer assembly 250 is movable between the withdrawn position and the retracted position, e.g., along the transverse direction T. In the withdrawn position, drawer assembly 250 is at least partially withdrawn from manifold 212 so that a user may readily access one or more additive compartments of drawer assembly 250, e.g., to fill one of the compartments with an additive. In the retracted position, drawer assembly 250 is received within manifold 212, e.g., so that one or more of the additive compartments of drawer assembly 250 are in fluid communication with water inlet valve 195 and tub 114 during operation of washing machine appliance 100.

Generally, drawer assembly 250 includes a drawer 252 and a handle 254. A user may grasp handle 254 of drawer assembly 250 to slide or move drawer assembly 250 between the withdrawn and retracted positions. An opening 194 defined by front panel 104 allows drawer assembly 250 to slide or move between the withdrawn and retracted positions.

For this embodiment, as shown in FIG. 5, manifold 212 of diffuser assembly 210 is positioned at top 103 and first side 123 of cabinet 102. In this way, when drawer assembly 250 is moved to the withdrawn position, a user may readily access the contents of drawer assembly 250 at the front of washing machine appliance 100. However, in alternative exemplary embodiments, manifold 212 and drawer assembly 250 may be positioned in other suitable locations. For example, manifold 212 and drawer assembly 250 slidably received within manifold 212 may be positioned at top 103 and second side 125 (FIG. 4) of cabinet 102.

As noted above, drawer assembly 250 includes drawer 252, and drawer 252 defines one or more additive compartments. In particular, as shown best in FIG. 6, drawer 252 defines a first additive compartment 256, a second additive compartment 258, and a third additive compartment 260. For this embodiment, first additive compartment 256 is a powder detergent compartment, second additive compartment 258 is a liquid softener compartment, and third additive compartment 260 is a liquid bleach compartment. As such, first additive compartment 256 is configured to receive a powder detergent and is defined by drawer 252 proximate the front of drawer assembly 250. First additive compartment 256 extends generally along the width of drawer assembly 250, e.g., along the lateral direction L. Second additive compartment 258 is configured to receive a liquid softener and is defined by drawer 252 rearward or back of first additive compartment 256, e.g., along the transverse direction T, and is positioned generally along the second side of drawer 252, e.g., along the lateral direction L. Third additive compartment 260 is configured to receive a liquid bleach and is defined by drawer 252 rearward or back of first additive compartment 256 and second additive compartment 258, e.g., along the transverse direction T. Third additive compartment 260 is positioned generally along the second side of drawer 252, e.g., along the lateral direction L. In alternative embodiments, the additive compartments may have other suitable configurations and may be configured to receive different additives.

The additive compartments are in fluid communication with water inlet valve 195 via respective supply lines. In particular, first additive compartment 256 is in fluid communication with water inlet valve 195 via a first supply line 382, second additive compartment 258 is in fluid communication with water inlet valve 195 via a second supply line 384, and third additive compartment 260 is in fluid communication with water inlet valve 195 via a third supply line 386. As shown in FIG. 6, first, second, and third supply lines 382, 384, 386 are each connected to respective ports of manifold 212. In FIG. 7, second supply line 384 is shown connecting to an inlet port of manifold 212. Manifold 212 includes a diffuser top 226 that defines a plurality of inlet passages. Each inlet passage fluidly connects one of the first, second, and third supply lines 382, 384, 386 with the first, second, and third additive compartments 256, 258, 260, respectively. For instance, as shown in FIG. 7, a second inlet passage 230 that fluidly connects second supply line 384 with second additive compartment 258 is shown (when drawer assembly 250 is in the retracted position; not shown in FIG. 7). As shown, second inlet passage 230 extends from second supply line 384 along the transverse length of manifold 212 and terminates where a plurality of diffuser openings 234 are defined by a bottom wall 236 of diffuser top 226. As shown in phantom lines in FIG. 5, diffuser top 226 may likewise define a first inlet passage 228 that fluidly connects first supply line 382 with first additive compartment 256 and diffuser top 226 may also define a third inlet passage 232 that fluidly connects third supply line 386 with third additive compartment 260. The inlet passages may be spaced from one another, e.g., along the lateral direction L.

For this embodiment, controller 180 (FIG. 2) is communicatively coupled with water inlet valve 195, e.g., via a wireless or wired connection. In this way, controller 180 may selectively control the designated valve of water inlet valve 195 to open or close to control the flow rate and volume of water flowing into the respective additive compartments 256, 258, 260. When water is supplied from water inlet valve 195 to manifold 212 and into one or more of the additive compartments 256, 258, 260, the water mixes with the additive contained within the additive compartment to form a wash fluid. Eventually, as shown particularly in FIG. 8, sufficient wash fluid (e.g., additive and water) will fill the additive compartment to form a siphon in a siphon valve 262. At that time, the wash fluid WF will be drawn by siphon valve 262 to exit the additive compartment as will be understood by those skilled in the art. That is, the wash fluid WF flows from the additive compartment (second additive compartment 258 is shown in FIG. 8) into an annular gap G defined between a cap 264 and a siphon column 266 of siphon valve 262 and flows into a top opening 268 defined by siphon column 266. The wash fluid WF then flows downward, e.g., along the vertical direction V, through a bottom opening 270 defined at the bottom of the siphon column 266. The wash fluid WF flows into an additive delivery channel 272 oriented along the bottom of drawer 252. When drawer assembly 250 is in the retracted position, the wash fluid WF flows from additive delivery channel 272 into tub supply conduit 380 so that the wash fluid WF may ultimately be delivered to tub 114. For first additive compartment 256, as shown in FIG. 7, an opening is defined in a bottom wall of the compartment and wash fluid (e.g., powder and water) may flow into additive delivery channel 272 and flow ultimately to tub 114.

As shown in FIGS. 6 and 10, drawer 252 also defines a filling compartment 274 configured to receive a fluid additive, such as e.g., a liquid detergent. Filling compartment 274 is spaced from second additive compartment 258 and third additive compartment 260, e.g., along the lateral direction L, and is positioned rearward or back of first additive compartment 256, e.g., along the transverse direction T. Drawer 252 has a partition wall 276 (FIG. 6) that partitions filling compartment 274 from second additive compartment 258 and third additive compartment 260. As such, filling compartment 274 is not in liquid communication with second additive compartment 258 or third additive compartment 260. Additionally, filling compartment 274 is not in liquid communication with first additive compartment 256. Access to filling compartment 274 is provided by an access member 278, which in this embodiment is a lid that is rotatably hinged to a top wall 280 of filling compartment 274 as shown in FIG. 9. As depicted in FIG. 10, when access member 278 is in an open position, fluid additive FA may be filled or directed into a filling opening 282 defined by top wall 280 of filling compartment 274. In alternative exemplary embodiments, access member 278 may be other suitable types of members that provide selective access to filling compartment 274. For instance, access member 278 may be a sliding door that slides along the transverse direction T to provide selective access to filling opening 282.

With reference specifically to FIG. 10, when drawer assembly 250 is in the withdrawn position, filling compartment 274 is in fluid communication manifold 212. More particularly, as shown, drawer 252 defines a delivery channel 284 positioned below filling compartment 274, e.g., along the vertical direction V. Delivery channel 284 and additive delivery channel 272 (FIG. 7) are not in liquid communication. An opening 288 defined by a bottom wall 286 of filling compartment 274 provides fluid communication between filling compartment 274 and delivery channel 284. Notably, bottom wall 286 of filling compartment 274 extends between a front 290 and a back 292 of filling compartment 274. As shown, bottom wall 286 of filling compartment 274 is angled downward from front 290 to back 292 of filling compartment 274 such that when fluid additive FA is poured or filled into filling opening 282 of filling compartment 274, the fluid additive FA flows downward toward back 292 along angled bottom wall 286 such that the fluid additive FA is directed through opening 288. As further shown in FIG. 10, delivery channel 284 is likewise angled downward from a front to a back of delivery channel 284 so that fluid additive FA that flows through opening 288 is directed through a delivery channel outlet 294 defined by drawer 252. The delivery channel outlet 294 provides fluid communication between drawer assembly 250 and diffuser assembly 210, or more particularly, between delivery channel 284 of drawer 252 and interior volume 214 of manifold 212.

Further, a bottom wall 224 of manifold is angled downward from front 216 to back 218 of manifold 212 so that fluid additive FA that flows through delivery channel outlet 294 may flow downward (e.g., along the vertical direction V) toward bulk tank 300 of dispensing assembly 200, e.g., when drawer assembly 250 is in the withdrawn position. Fluid additive exits manifold 212 through an outlet defined by a manifold outlet port 296 and flows downstream to bulk tank 300, e.g., through a connecting hose clamped at one end to the manifold outlet port 296 and bulk tank 300. Accordingly, filling compartment 274 is in fluid communication with bulk tank 300 even when drawer assembly 250 is in the withdrawn position. Advantageously, by allowing for fluid communication between filling compartment 274 and bulk tank 300 when drawer assembly 250 is in the withdrawn position, a user may pour a significant volume of fluid additive FA into filling compartment 274 without moving drawer assembly 250 to the retracted position to allow for filling compartment 274 to empty so that more fluid additive FA may then be filled into filling compartment 274. That is, a user may fill or refill bulk tank 300 in one pour without need for adjustment of drawer assembly 250 or other moving components of washing machine appliance 100.

Filling compartment 274 is also in fluid communication with bulk tank 300 when drawer assembly 250 is in the retracted position in the same fashion as described above except that fluid additive FA flowing through delivery channel outlet 294 flows directly or nearly directly into manifold outlet port 296 and into bulk tank 300.

As shown best in FIGS. 3, 6, and 11, dispensing assembly 200 includes bulk tank 300 or bulk reservoir. As noted above, bulk tank 300 is configured to receive a fluid additive, such as e.g., a liquid detergent. For this embodiment, bulk tank 300 is a large capacity tank. In some embodiments, for instance, bulk tank 300 is sized to hold at least seven tenths of a gallon (0.7 gallons) of a fluid additive. In yet other exemplary embodiments, bulk tank 300 is sized to hold at least one gallon (1 gallon) of the fluid additive. The large capacity of bulk tank 300 allows a user to run a multitude or plurality of wash cycles without need to refill the tank after each cycle. This may, for example, reduce a user's manual efforts of pouring, measuring, and filling the tank for a particular laundry load. For example, a user may run about ninety (90) wash cycles under normal conditions or execute wash cycles under normal conditions for three to four (3-4) months without need to refill bulk tank 300 with a new supply of fluid additive. As will be explained further herein, in some exemplary embodiments, the amount of fluid additive directed from bulk tank 300 to tub 114 may be controlled, e.g., based upon the cycle selected and by controlling water inlet valve 195.

Further, in some exemplary embodiments, bulk tank 300 is formed by a blow molding process. By utilizing a blow molding process to form bulk tank 300, bulk tank 300 may be produced at a lesser cost, e.g., than by utilizing an injection molding process. However, in alternative exemplary embodiments, bulk tank 300 may be formed by other suitable manufacturing processes, such as e.g., injection molding, an additive manufacturing process, etc.

For this embodiment, bulk tank 300 is positioned at or adjacent back 129 of cabinet 102 and at or adjacent top 103 of cabinet 102 (see FIGS. 1 and 11). Bulk tank 300 extends between a front 302 and a back 304 (FIG. 6), e.g., along the transverse direction T, and between a top 306 and a bottom 308 (FIG. 11), e.g., along the vertical direction V. As shown particularly in FIG. 3, for this embodiment, the transverse length of bulk tank 300 is about half the transverse length of cabinet 102. Bulk tank 300 includes a tank body 310 (FIG. 11) and an extension portion 312 (FIG. 5) projecting from tank body 310, e.g., along the vertical direction V. Further, as shown best in FIG. 10, bulk tank 300 includes an inlet port 314 that projects from tank body 310 at front 302 of bulk tank 300. Inlet port 314 defines an inlet 318 of bulk tank 300. As shown in FIG. 12, bulk tank 300 also includes outlet port 316 that projects from tank body 310 at back 304 of bulk tank 300. More particularly, outlet port 316 projects from bottom 308 of tank body 310 at back 304 as best shown in FIG. 12. Outlet port 316 defines an outlet 320 of bulk tank 300.

With reference again to FIGS. 3 and 5, bulk tank 300 is fixed relative to cabinet 102. More particularly, bulk tank 300 is secured in place and to cabinet 102 by a support bracket 330. Support bracket 330 extends between a first side 332 and a second side 334 (FIG. 5), e.g., along the lateral direction L. First side 332 of support bracket 330 is connected to a flange of cabinet 102 at first side 123 of cabinet 102 and second side 334 of support bracket 330 is connected to a structural member 336 as shown in FIG. 3. Structural member 336 spans between front 127 and back 129 of cabinet 102 and is oriented along the transverse direction T. Support bracket 330 is connected to extension portion 312 (FIG. 5) of bulk tank 300. As noted previously, extension portion 312 projects upward from tank body 310, e.g., along the vertical direction V. As shown best in FIG. 6, extension portion 312 includes a first mating surface 338 and a second mating surface 340 spaced from first mating surface 338, e.g., along the lateral direction L. Notably, as shown best in FIG. 5, extension portion 312 defines a cutout 342 configured to receive one or more supply lines. Cutout 342 is defined by extension portion 312 between first mating surface 338 and second mating surface 340, e.g., along the lateral direction L. First mating surface 338 and second mating surface 340 each extend in a plane orthogonal to the vertical direction V. An opening is defined by first mating surface 338 and an opening is defined by second mating surface 340. The openings may be blind openings. The openings are configured to receive screws or other mechanical fasteners so that support bracket 330 may be secured to extension portion 312 of bulk tank 300, e.g., to hold or secure bulk tank 300 in place. In FIG. 3, support bracket 330 is shown secured to bulk tank 300.

As shown in FIGS. 3, 6, and 13, liquid level sensor 350 is at least partially positioned in or disposed within an interior volume of bulk tank 300. As shown in FIG. 13, liquid level sensor 350 is configured to sense a liquid level LL of the fluid additive FA within bulk tank 300. Liquid level sensor 350 may be any suitable type of sensor capable of sensing the liquid level LL of the fluid additive FA within bulk tank 300. As one example, liquid level sensor 350 may be a conductivity sensor. The conductivity sensor may be a dual probe conductivity sensor with one probe configured to sense when the fluid additive FA has reached or exceeded a predetermined maximum liquid level and the other probe configured to sense when the fluid additive FA has fallen below or is less than a predetermined minimum liquid level. As another example, liquid level sensor 350 may be a float sensor. Float sensors, or liquid level floats or float balls, may be spherical, cylindrical, oblong or similarly shaped objects made from either rigid or flexible material. The float is buoyant in the fluid additive. The float sensor may be incorporated into switch mechanisms or translucent fluid-tubes as a component in monitoring or controlling the liquid level LL. As yet another example, liquid level sensor 350 may be an ultrasonic level sensor. As a further example, liquid level sensor 350 may be an optical level sensor.

In some exemplary embodiments, controller 180 (FIG. 2) is communicatively coupled with liquid level sensor 350. In this way, controller 180 may receive one or more signals generated by liquid level sensor 350, and vice versa. For instance, in some embodiments, controller 180 is configured to receive a signal generated by liquid level sensor 350. The signal generated by liquid level sensor 350 is indicative of the liquid level LL of the fluid additive FA within bulk tank 300. For example, the signal may be a voltage or current signal. Controller 180 may process the signal to determine the liquid level LL of the fluid additive FA within bulk tank 300. Controller 180 is also configured to determine whether the liquid level LL of the fluid additive FA is less than a predetermined liquid level based at least in part on the signal. The predetermined liquid level may be representative of a low liquid level, for example. The predetermined liquid level may be set by a user or alternatively the predetermined liquid level may be a default liquid level, e.g., as set at the factory. If the liquid level LL of the fluid additive FA is less than the predetermined liquid level, controller 180 is further configured to generate a notification descriptive of a low liquid level condition of the fluid additive FA within bulk tank 300. The notification may include information as to the current liquid level LL, a warning that the liquid level is low, a predicted number of washes remaining before the fluid additive FA runs out, etc. Thereafter, controller 180 is configured to communicate the notification to a user. As one example, controller 180 may control display 111 of control panel 108 (FIG. 1) to display or present the notification to the user. As another example, controller 180 includes a communication interface that allows for washing machine appliance 100 to communicate with a user, e.g., over a network or via a voice command. For instance, the communication interface of controller 180 may rout the notification to a user's electronic device such that the notification is displayed on the user's device. The notification may be a "push notification", for example.

Further, in some exemplary embodiments, the communication interface of controller 180 is configured to communicate with the user by prompting the user to determine whether the user desires a new supply of the fluid additive FA. For example, the prompt may be sent as a push notification to a user's electronic device, such as e.g., a user's smartphone. If the user desires the new supply of the fluid additive FA, then controller 180 is configured order the new supply of the fluid additive FA. The user may be prompted with fluid additive purchasing options, and once a new supply of fluid additive is selected, controller 180 may automatically place the order.

With reference now to FIGS. 14 through 16, dispensing assembly 200 also includes a pump for selectively directing or delivering fluid additive FA from bulk tank 300 to the tub 114. That is, the pump is configured to draw fluid additive from bulk tank 300 such that it may ultimately be delivered to or dispensed into tub 114 for treating articles disposed within tub 114. For this embodiment, the pump is a Venturi pump or aspirator 360. In alternative embodiments, however, pump may be an electric pump or other suitable pump for directing fluid additive from bulk tank 300 to tub 114.

Aspirator 360 produces a vacuum by means of the Venturi effect to draw fluid additive FA from bulk tank 300. In particular, as shown best in FIG. 16, aspirator 360 includes an inlet port 362, a suction port 364, and a discharge port 366. Inlet port 362 of aspirator 360 is in fluid communication with water inlet valve 195 (FIGS. 14 and 15) via a water supply line 368. Water inlet valve 195 is communicatively coupled with controller 180 (FIG. 2). In this way, controller 180 may selectively control the designated valve of water inlet valve 195 to open or close to control the flow rate and volume of water flowing into inlet port 362 of aspirator 360, e.g., to achieve the desired vacuum to draw a controlled amount of fluid additive FA from bulk tank 300. Suction port 364 of aspirator 360 is in fluid communication with bulk tank 300 via a suction line 370. When water W is directed through a Venturi nozzle 372 of inlet port 362, the pressure of the water W flowing through the constricting section of Venturi nozzle 372 decreases and the velocity of the water W increases. The decreased pressure of the water W downstream of the constricting section creates a vacuum that pulls or draws fluid additive FA from bulk tank 300 to suction port 364 of aspirator 360. Thus, the amount of fluid additive FA dispensed into tub 114 may be controlled by adjusting the water flow through inlet port 362 of aspirator 360. Discharge port 366 is in fluid communication with tub supply conduit 380 (and ultimately tub 114) via a discharge line 374 as shown best in FIGS. 14 and 15. The mixture of water W from inlet port 362 and fluid additive FA from suction port 364 forms wash fluid WA. The wash fluid WA exits aspirator 360 through discharge port 366 and flows downstream to tub supply conduit 380 via discharge line 374. When the mixture of water W and fluid additive FA (or wash fluid WA) reaches tub supply conduit 380, the wash fluid WA mixes with wash fluid flowing downstream from one or more of the additive compartments 256, 258, 260 of drawer assembly 250 (FIG. 3). Finally, the mixture of wash fluid is dispensed or directed into tub 114 through spout 130 of tub supply conduit 380, e.g., as shown in FIG. 2.

Washing machine appliance 100 disclosed herein provides a number of advantages. For instance, the large capacity of bulk tank 300 allows users to run a multitude of wash cycles without need to refill bulk tank 300 after each cycle. Further, as dispensing assembly 200 includes a means for bulk tank 300 to be readily refilled with additive without moving bulk tank 300, refilling of bulk tank 300 is made easy. As bulk tank 300 is fixed relative to cabinet 102, a user need not move bulk tank 300, e.g., during refilling. Further, as bulk tank 300 is positioned at or adjacent a top portion of cabinet 102, space below the tub 114 may be utilized for other uses, such as e.g., machinery to drive basket 120 or drain tub 114. In addition, the bulk tank 300 may be blow molded, which may reduce the cost of manufacturing the tank. As will be appreciated, the exemplary embodiments of washing machine appliance 100 described herein may have other advantages and benefits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A horizontal axis washing machine appliance, comprising:
- a cabinet;
- a tub positioned within the cabinet;
- a basket rotatably mounted within the tub, the basket defining a wash chamber for receipt of articles for washing;
- a water inlet valve in fluid communication with a water source; and
- a dispensing assembly, comprising:
  - a manifold;
  - a drawer assembly slidably received within the manifold and movable between a withdrawn position and a retracted position, the drawer assembly comprising a drawer defining one or more additive compartments and a filling compartment configured for receipt of a fluid additive;
  - a bulk tank in fluid communication with the filling compartment;
  - a tub supply conduit, the tub supply conduit providing fluid communication between the one or more additive compartments and the tub;
  - a pump in fluid communication with the bulk tank and the tub supply conduit for selectively directing the fluid additive from the bulk tank to the tub, and
  - a liquid level sensor at least partially disposed within the bulk tank, the liquid level sensor configured to sense a liquid level of the fluid additive within the bulk tank.

2. The horizontal axis washing machine appliance of claim 1, wherein the bulk tank is sized to hold at least seven tenths of a gallon (0.7 gallons) of the fluid additive.

3. The horizontal axis washing machine appliance of claim 1, wherein the bulk tank is sized to hold at least one gallon (1 gallon) of the fluid additive.

4. The horizontal axis washing machine appliance of claim 1, wherein the cabinet extends between a top and a bottom, and wherein the bulk tank is positioned at or adjacent the top of the cabinet.

5. The horizontal axis washing machine appliance of claim 1, wherein the bulk tank is in fluid communication with the filling compartment when the drawer assembly is in the retracted position and when the drawer assembly is in the withdrawn position.

6. The horizontal axis washing machine appliance of claim 5, wherein the cabinet extends between a front and a back, and wherein the bulk tank is positioned at or adjacent the back of the cabinet.

7. The horizontal axis washing machine appliance of claim 1, wherein when the drawer assembly is in the withdrawn position, the manifold provides fluid communication between the filling compartment and the bulk tank.

8. The horizontal axis washing machine appliance of claim 1, wherein the pump is an aspirator, and wherein the aspirator is in fluid communication with the bulk tank via a suction line, and wherein the aspirator is in fluid communication with the water inlet valve via a water supply line, and wherein the aspirator is in fluid communication with the tub supply conduit via a discharge line.

9. The horizontal axis washing machine appliance of claim 1, further comprising:
- a controller communicatively coupled with the liquid level sensor, the controller configured to:
  - receive a signal generated by the liquid level sensor, the signal indicative of the liquid level of the fluid additive within the bulk tank;
  - determine whether the liquid level of the fluid additive is less than a predetermined liquid level based at least in part on the signal; and
  - generate, if the liquid level of the fluid additive is less than the predetermined liquid level, a notification descriptive of a low liquid level condition of the fluid additive within the bulk tank;
  - communicate the notification to a user.

10. The horizontal axis washing machine appliance of claim 9, wherein the controller comprises a communication interface, and wherein the controller is further configured to:
- prompt the user to determine whether the user desires a new supply of the fluid additive; and
- order the new supply of the fluid additive if the user desires the new supply of the fluid additive.

11. The horizontal axis washing machine appliance of claim 1, wherein the bulk tank is fixed relative to the cabinet.

12. The horizontal axis washing machine appliance of claim 1, wherein the manifold extends between a front and back, and wherein the manifold comprises a bottom wall extending between the front and the back, and wherein the bottom wall of the manifold is angled downward from the front to the back.

13. The horizontal axis washing machine appliance of claim 1, wherein the washing machine appliance defines a vertical direction, and wherein the bulk tank comprises a tank body and an extension portion projecting upward along the vertical direction from the tank body, and wherein the extension portion defines a cutout configured to receive one or more supply lines.

14. The horizontal axis washing machine appliance of claim 13, wherein the cabinet extends between a front and a back, and wherein the horizontal axis washing machine appliance further comprises:
- a structural member extending between and connecting the front and the back of the cabinet;
- wherein the dispensing assembly further comprises a support bracket extending between a first side and a second side, and wherein the first side of the support bracket is connected to the cabinet, the second side of the support bracket is connected to the structural member, and the support bracket is connected to the extension portion of the bulk tank.

15. The horizontal axis washing machine appliance of claim 1, wherein the bulk tank is formed by a blow molding process.

16. The horizontal axis washing machine appliance of claim 1, wherein the filling compartment defined by the drawer is in fluid communication with a delivery channel defined along a bottom of the drawer, and wherein the delivery channel is in fluid communication with the manifold and the manifold is in fluid communication with the bulk tank when the drawer assembly is in the withdrawn position.

17. A washing machine appliance, comprising:

a cabinet extending between a front and a back and between a top and a bottom;

a tub positioned within the cabinet;

a basket rotatably mounted within the tub, the basket defining a wash chamber for receipt of articles for washing;

a water inlet valve in fluid communication with a water source; and a dispensing assembly, comprising:

a manifold;

a drawer assembly slidably received within the manifold and movable between a withdrawn position and a retracted position, the drawer assembly comprising a drawer defining one or more additive compartments and a filling compartment configured for receipt of a fluid additive;

a bulk tank fixed relative to the cabinet and in fluid communication with the filling compartment, the bulk tank positioned at or adjacent the top and the back of the cabinet, wherein the fluid additive flows from the filling compartment to the bulk tank;

a tub supply conduit, the tub supply conduit providing fluid communication between the one or more additive compartments and the tub; and a pump in fluid communication with the bulk tank and the tub supply conduit for selectively directing the fluid additive from the bulk tank to the tub.

18. The washing machine appliance of claim 17, wherein when the drawer assembly is in the withdrawn position, the manifold provides fluid communication between the filling compartment and the bulk tank.

* * * * *